US011066927B2

(12) United States Patent
Kusuma et al.

(10) Patent No.: US 11,066,927 B2
(45) Date of Patent: Jul. 20, 2021

(54) WIRED DRILL PIPE CONNECTOR AND SENSOR SYSTEM

(71) Applicant: SCHLUMBERGER TECHNOLOGY CORPORATION, Sugar Land, TX (US)

(72) Inventors: Julius Kusuma, Arlington, MA (US); Jimmy Varughese, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 987 days.

(21) Appl. No.: 15/342,966

(22) Filed: Nov. 3, 2016

(65) Prior Publication Data

US 2017/0204723 A1 Jul. 20, 2017

Related U.S. Application Data

(60) Provisional application No. 62/250,045, filed on Nov. 3, 2015.

(51) Int. Cl.

| | |
|---|---|
| ***E21B 47/12*** | (2012.01) |
| ***E21B 17/00*** | (2006.01) |
| ***E21B 47/02*** | (2006.01) |
| ***E21B 17/02*** | (2006.01) |

(52) U.S. Cl.

CPC ..... *E21B 47/12* (2013.01); *E21B 17/003* (2013.01); *E21B 17/028* (2013.01); *E21B 47/02* (2013.01)

(58) Field of Classification Search

CPC ..... E21B 47/12; E21B 17/003; E21B 17/028; E21B 47/02

See application file for complete search history.

(56) References Cited

U.S. PATENT DOCUMENTS

| | | | | |
|---|---|---|---|---|
| 6,670,880 | B1 * | 12/2003 | Hall | F16L 25/01 336/132 |
| 2005/0207279 | A1 * | 9/2005 | Chemali | E21B 17/028 367/83 |
| 2008/0159077 | A1 * | 7/2008 | Madhavan | E21B 17/028 367/76 |
| 2008/0211687 | A1 * | 9/2008 | Price | E21B 17/028 340/854.3 |
| 2009/0084541 | A1 * | 4/2009 | Braden | E21B 17/028 166/242.6 |
| 2010/0300698 | A1 * | 12/2010 | Bedouet | E21B 17/003 166/355 |
| 2011/0226470 | A1 * | 9/2011 | Latrille | E21B 41/0085 166/250.01 |

* cited by examiner

*Primary Examiner* — Yong-Suk (Philip) Ro

(57) ABSTRACT

A downhole tool and a wired drill string assembly including a downhole tool. The downhole tool includes a body having a first connector and a second connector. At least the first connector is configured to be connected to a wired drill pipe. The downhole tool also includes one or more electrical components coupled to the body and configured to receive a first signal and transmit a second signal. The downhole tool further includes a first transmission line extending along the body to the first connector and electrically connected to the one or more electrical components. The first transmission line is configured to be electrically connected to a transmission wire of the wired drill pipe when the wired drill pipe is connected to the first connector.

11 Claims, 4 Drawing Sheets

WIRED DRILL PIPE CONNECTOR AND SENSOR SYSTEM

CROSS-REFERENCE TO RELATED APPLICATION

This application claims the benefit of U.S. Provisional Application No. 62/250,045, filed Nov. 3, 2015.

BACKGROUND

In the oilfield, wellbores are created by boring a hole in the earth using a bottom-hole assembly (BHA) at the end of a drill string. The BHA, in turn, generally includes one or more measurement-while-drilling (MWD) devices, including sensors, which are communicable with equipment at the surface of the well. Such MWD devices may be employed to take "surveys" of the well drilling process, generally providing information related to direction (azimuth) and inclination of the BHA.

The devices that provide communication from the BHA to the surface are usually either pressure actuators, which send pressure pulses through the drilling mud (i.e., "mud pulse telemetry"), or electromagnetic transmitters that send electromagnetic pulses through the earth ("EMag telemetry"). The transmitters for each of these types of signals generally use a large amount of power, and thus large batteries or a turbine generator may be provided in the BHA for powering these devices.

Recently, wired drill pipe has been employed to send communication signals via a wired connection directly to/from surface equipment. Communication via wired drill pipe may have increased power efficiency, and the devices that provide such communication at the BHA may not demand turbines or large batteries. In implementation, a wired drill pipe telemetry sub is connected to the top of a BHA, with the BHA providing the aforementioned MWD sensors. The communication devices within the wired drill pipe telemetry sub are connected to the MWD devices, which relay the information from the sensors to the surface. However, the BHA generally still includes mud pulse or EMag telemetry transmitters, e.g., to provide backup or redundancy in communication abilities.

SUMMARY

Embodiments of the present disclosure may provide a downhole tool. The downhole tool includes a body having a first connector and a second connector. At least the first connector is configured to be connected to a wired drill pipe. The downhole tool also includes one or more electrical components coupled to the body and configured to receive a first signal and transmit a second signal. The downhole tool further includes a first transmission line extending along the body to the first connector and electrically connected to the one or more electrical components. The first transmission line is configured to be electrically connected to a transmission wire of the wired drill pipe when the wired drill pipe is connected to the first connector.

Embodiments of the disclosure may further provide a wired drill string assembly. The assembly includes drill pipes extending from a surface into a wellbore and including a transmission line. The assembly also includes a downhole tool that includes a body having a first connector and a second connector, the first connector being connected to one of the drill pipes. The downhole tool also includes at least one electrical component including a sensor coupled to the body and a signal transmitter configured to transmit a signal representing a measurement taken by the sensor. The downhole tool further includes a first transmission line extending along the body and electrically connected to a transmission wire of the drill pipes and with the one or more electrical components.

The foregoing summary is intended merely to introduce a few of the aspects of the present disclosure, which are more fully described below. Accordingly, this summary should not be considered exhaustive.

BRIEF DESCRIPTION OF THE DRAWINGS

The present disclosure may be understood by referring to the following description and accompanying drawings that are used to illustrate some embodiments. In the drawings.

DETAILED DESCRIPTION

Figure 1:
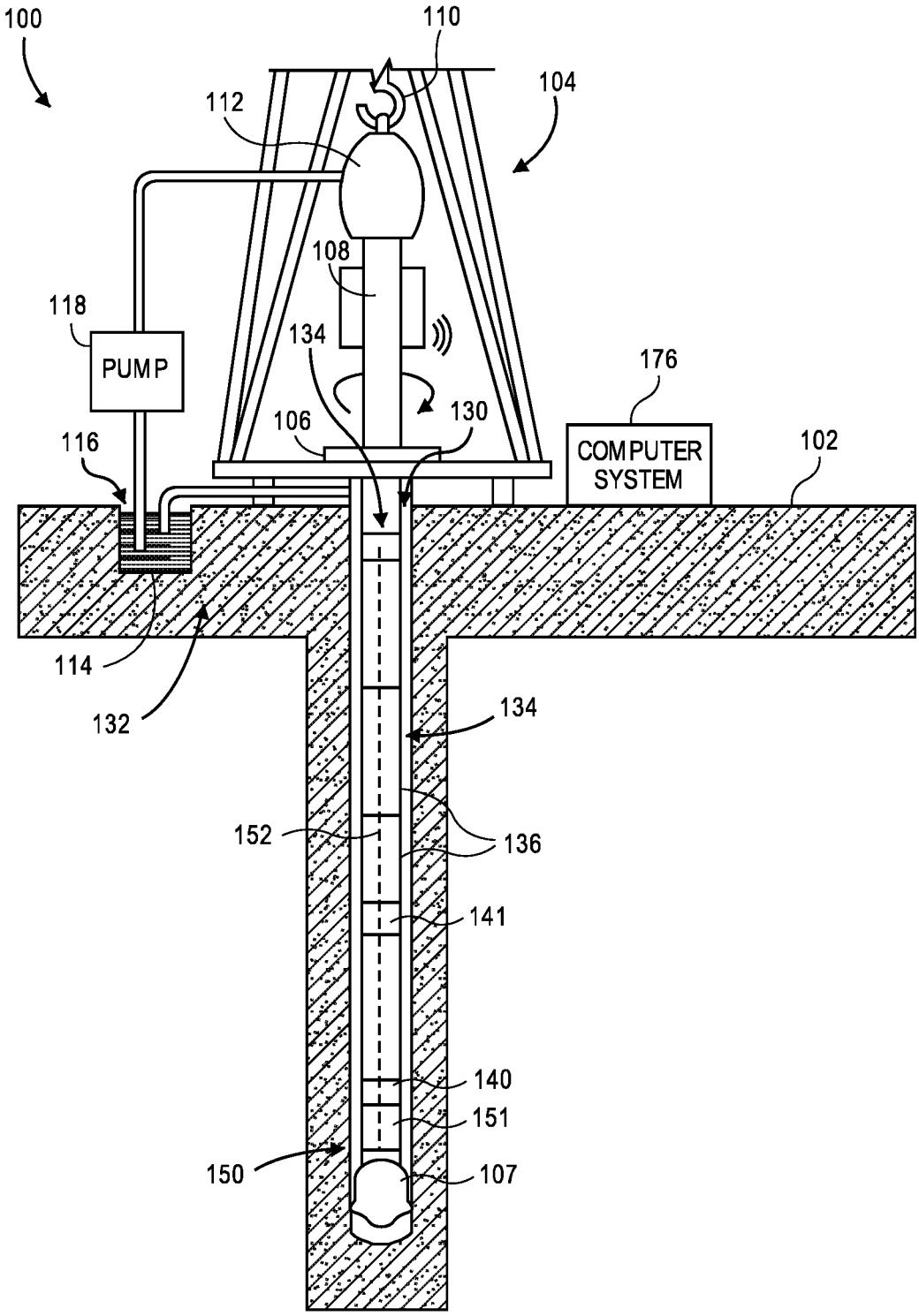
FIG. 1 illustrates a simplified, side, cross-sectional view of a wellsite system, including a first downhole tool and a second downhole tool, according to an embodiment.

The following describes several embodiments for implementing different features, structures, or functions of the present disclosure. Embodiments of components, arrangements, and configurations are described below to simplify the present disclosure; however, these embodiments are provided merely as examples and are not intended to limit the scope of the present disclosure. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one example embodiment may be used in any other example embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the present disclosure, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a cross-sectional view of a wellsite system 100 including one or more downhole tools, for example, a first downhole tool 140 and a second downhole tool 141, positioned in a wellbore 130, according to an embodiment. The wellbore 130 may extend from the surface 102 and may be formed in a subsurface formation 132 by rotary drilling in any suitable manner. For example, some embodiments may employ directional drilling.

The wellsite system 100 may include a platform and derrick assembly 104 positioned over the wellbore 130, with the derrick assembly 104 including a rotary table 106, a kelly 108, a hook 110, and a rotary swivel 112. In a drilling operation, a drill string assembly 134 may be rotated by the rotary table 106, which engages the kelly 108 at the upper end of the drill string assembly 134. The drill string assembly 134 may be suspended from the hook 110, attached to a traveling block (not shown), through the kelly 108 and the rotary swivel 112, which permits rotation of the drill string assembly 134 relative to the hook 110. In some embodiments, a top-drive drilling system may be employed.

Drilling fluid or mud 114 may be stored in a pit 116 formed at the wellsite. A pump 118 may deliver the drilling fluid 114 to the interior bore of the drill string assembly 134 via a port in the swivel 112, which causes the drilling fluid 114 to flow downwardly through the drill string assembly 134. The drilling fluid exits the drill string assembly 134 via ports in a drill bit 107 provided as part of a bottom-hole assembly ("BHA") 150, and then circulates upwardly through the annulus region between the outside of the drill string assembly 134 and the wall of the wellbore 130. In this manner, the drilling fluid lubricates the drill bit 107 and carries formation cuttings up to the surface as it is returned to the pit 116 for recirculation. In some embodiments, the bottom-hole assembly (BHA) 150 may include a mud motor, a rotary steerable system (RSS) 151, and/or any other devices designed to facilitate drilling the wellbore 130 in the subsurface formation 132.

The drill string assembly 134 may include several lengths or "joints" of drill pipe 136, which are mechanically connected together, end-to-end ("made up"). In some embodiments, the drill pipe 136 may be wired drill pipe, which may also be provided with a transmission wire 152, e.g., entrained within a wall thereof, clamped to the pipes 136, or otherwise positioned to run along the drill string assembly 134. The transmission wire 152 may be made of several lengths of wire, e.g., one or more for each pipe 136. The segments of the transmission wire 152 within each pipe 136 may be connected together when the pipes 136 are made-up together, so as to allow control and/or power signals to proceed up and/or down the drill string assembly 134.

The first downhole tool 140 may be positioned between the distal-most pipe 136 (i.e., farthest in the wellbore 130 from the surface 102) and the BHA 150. The second downhole tool 141 may be positioned between any two drill pipes 136 along the drill string assembly 134, between the surface 102 and the BHA 150.

Figure 2:
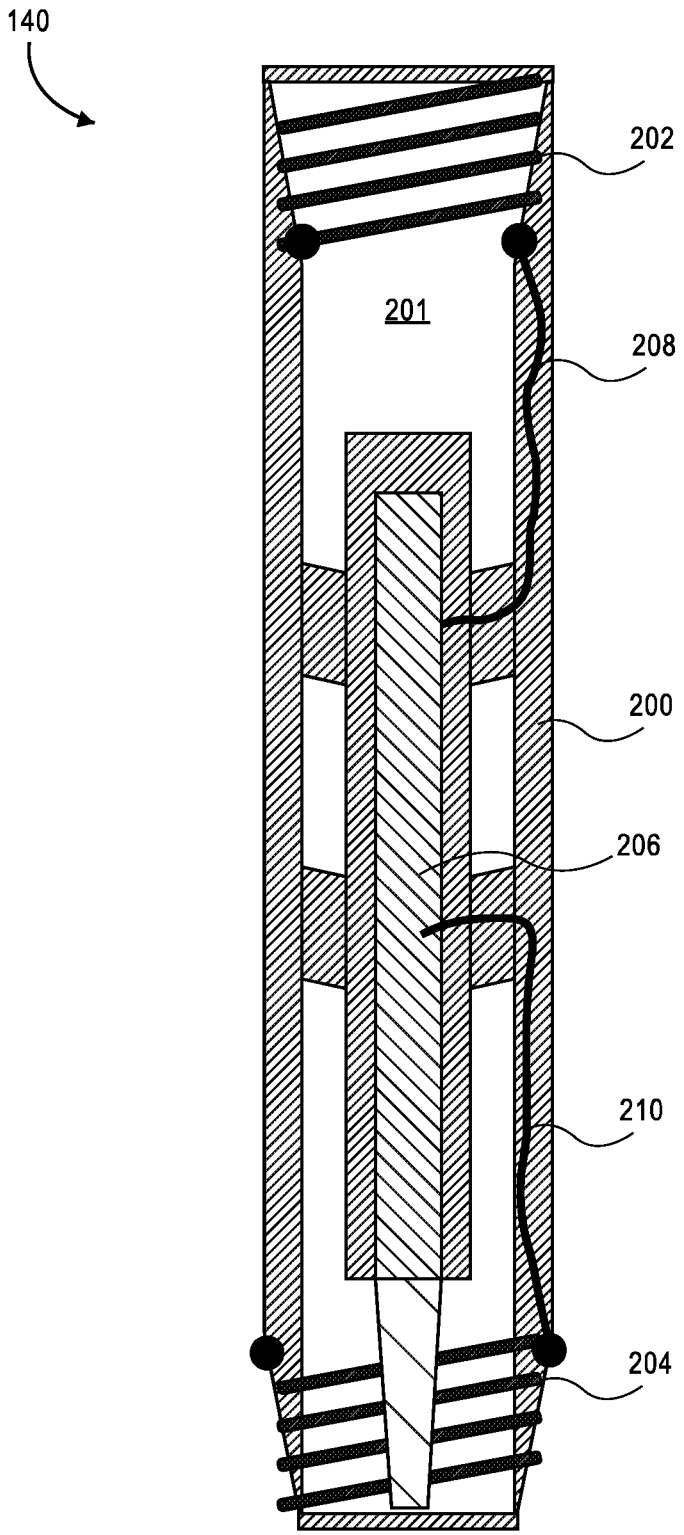
FIG. 2 illustrates a simplified, side, cross-sectional view of a downhole tool, which may be representative of an embodiment of either or both of first and second downhole tools, according to an embodiment.

With continuing reference to FIG. 1, FIG. 2 illustrates a schematic, side, cross-sectional view of the first downhole tool 140, according to an embodiment. Although the first downhole tool 140 is illustrated, it will be appreciated that the second downhole tool 141 may have substantially the same construction. The first downhole tool 140 may generally include a body or "sub" 200, which may have a generally cylindrical shape, and may provide a bore 201 therethrough. Further, the body 200 may have first and second connectors 202, 204 at either axial end thereof. For example, the first connector 202 may provide a box end, configured to receive and couple to a pin end of a superposed tubular (e.g., one of the pipes 136), and the second connector 204 may provide a pin end, which may be received around and coupled to a box end of a subjacent tubular (e.g., one of the pipes 136 or the BHA 150). Accordingly, the first connector 202 may be oriented "uphole" (i.e., toward the surface 102 when deployed in the wellbore 130), and the second connector 204 may be oriented "downhole" (i.e., downward, away from the surface 102). In one embodiment, the second connector 204 may provide a pin end. In another embodiment, the second connector 204 may include an extender having one or several conductors and connected to the electrical component of the downhole tool.

The downhole tool 140 may also include one or more electrical components 206, illustrated in a simplified, schematic form in FIG. 2. The electrical components 206 may be coupled to the body 200, and may, for example, reside at least partially within the outer diameter of the body 200, between the inner and outer diameter thereof. In other embodiments, the electrical components 206 may be on the exterior of the body 200 or within the bore 201 therethrough. The body 200 may also include a first transmission line 208 and/or a second transmission line 210. The first and second transmission lines 208, 210 may extend along (e.g., within) the body 200 and may be electrically connected to the electrical components 206. In particular, the first transmission line 208 may extend upward along the body 200 to the first connector 202, while the second transmission line 210 may extend downward along the body 200 to the second connector 204. Accordingly, when a wired tubular (e.g., drill pipe 136, BHA 150, etc.) is coupled with the first or second connector 202, 204, an electrical contact thereof may be electrically connected to either of the first or second transmission lines 208, 210, and thus to the electrical components 206, in addition to being mechanically coupled to the body 200. In some embodiments, the downhole tool 140 may also include a battery (e.g., coupled to the electrical components 206, the first or second connector 202, 204, and/or in the body 200). The battery may be configured to power or draw power from various parts of the downhole tool 140 and/or the BHA 150. For example, in some embodiments, the battery in the downhole tool 140 may provide power through the second connector 204 to the rest of the BHA 150, or the battery may draw power from the BHA 150 through the second connector 204.

In some embodiments, the electrical components 206 may include one or more sensors, a signal receiver, signal transmitter, and one or more processors. The one or more sensors may include direction and inclination sensors (e.g., inclinometers and/or magnetometers) and/or any other MWD sensors or the like. In an embodiment, the sensors may include sensors capable of determining an orientation of the toolface, or any other relevant orientation. In an embodiment, the sensors may include a gamma ray measurement device. The signal receiver may be configured to receive one or more signals via either of the transmission lines 208, 210, and the signal transmitter may be configured to generate and transmit one or more signals via either or the transmission lines 208, 210. It will be appreciated that the transmitter and receiver may be provided by a single electrical component.

In some embodiments, the second transmission line 210 may be omitted, and the first downhole tool 140 may provide an end-of-the line for the communication along the transmission wire 152 of the drill string assembly 134. Such an embodiment may provide for communication by the sensors of the electrical components 206 with equipment at the surface 102, and/or vice versa. In embodiments including the second transmission line 210, however, the electrical components 206 may be configured as a toolbus for inter-tool communication. That is, a downgoing signal from the equipment at the surface 102 may be received at the first downhole tool 140 and relayed thereby to the BHA 150, potentially after being processed by the first downhole tool 140. The BHA 150 may then adjust a drilling parameter, such as a rate of rotation, tool face angle, etc. in response to (e.g., as directed by) the downgoing signal.

Accordingly, measurements taken by the sensors within the electrical components 206, or external sensors, or sensors within separate components (e.g., the BHA 150), may be conveyed through a wired drill pipe uplink from the first downhole tool 140 to the surface 102, or to the BHA 150. Such information may be used to adjust the operation of directional drilling. When such measurements are conveyed, the raw sensor data may be transmitted and/or secondary or processed measurements, such as an estimate of rotation speed, a detection of stick slip, or shock and vibration, among potentially others, may be transmitted.

Figure 3:
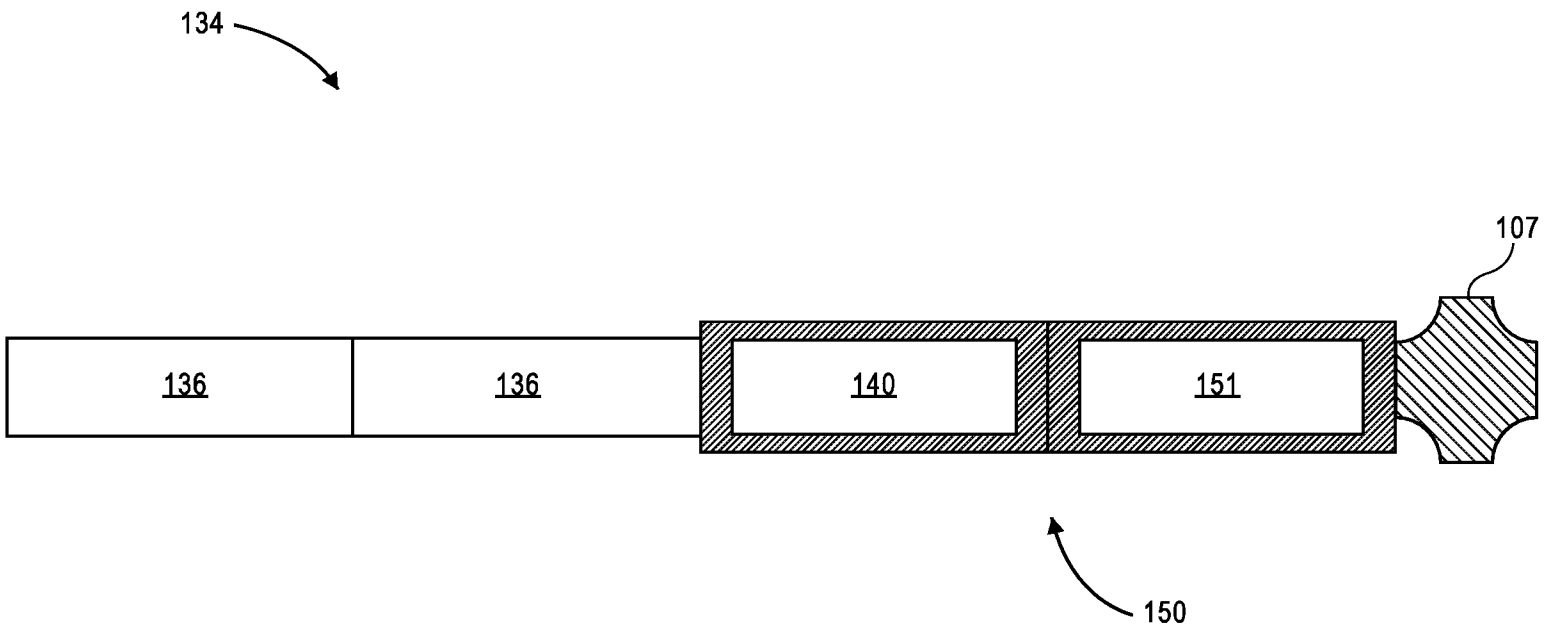
FIG. 3 illustrates a schematic view of a wired drill pipe assembly including the first downhole tool, according to an embodiment.

With continuing reference to FIG. 1, FIG. 3 illustrates a schematic view of the drill string assembly 134 including the first downhole tool 140, according to an embodiment. As mentioned above, the first downhole tool 140 may be made up to the distal-most pipe 136, to provide a connection to the BHA 150. As shown, the BHA 150 may be provided with the RSS 151 and the drill bit 107, although other components may also be provided. In some embodiments, the RSS 151 may be substituted with a mud motor, or any other device capable of imparting rotation to the drill bit 107 tubular within the wellbore 130.

The first downhole tool 140 may serve to collect and to transmit survey data to the surface 102 via the wired drill pipes 136. Accordingly, during a drilling operation, one or more surveys may be taken, e.g., at predetermined time, depth, etc. intervals. The sensors of the first downhole tool 140 may take measurements during such surveys, and may communicate signals representing this information to the transmitter. The transmitter, in turn, may transmit a signal representing the measurements taken by the sensors to the surface via the transmission wire 152 of the wired drill pipe 136.

As will be appreciated, separate MWD sensors may be omitted from the BHA 150, as the functionality thereof may be provided by the sensor(s) of the first downhole tool 140, thereby decreasing the size and complexity of the BHA 150, in at least some examples. In other embodiments, the BHA 150 may include separate sensors. Further, by removing power-intensive communication devices (e.g., mud pulse actuators, EMag transmitters, etc.) from the BHA 150, the sensors in the first downhole tool 140 may be positioned closer to the drill bit 107, which may facilitate accurately gauging the direction, inclination, etc., of the drill bit 107.

Furthermore, the first downhole tool 140 may be employed to facilitate logging-while-drilling ("LWD"). In such case, the first downhole tool 140, specifically the electrical components 206 (FIG. 2) thereof, may act as a bus master in a toolbus, such that the first downhole tool 140 may obtain LWD data points (and/or other measurements) from the RSS 151, and relay such data points to the surface 102 via the wired drill string assembly 134, e.g., along with the MWD data collected using the sensors of the first downhole tool 140.

Figure 4:
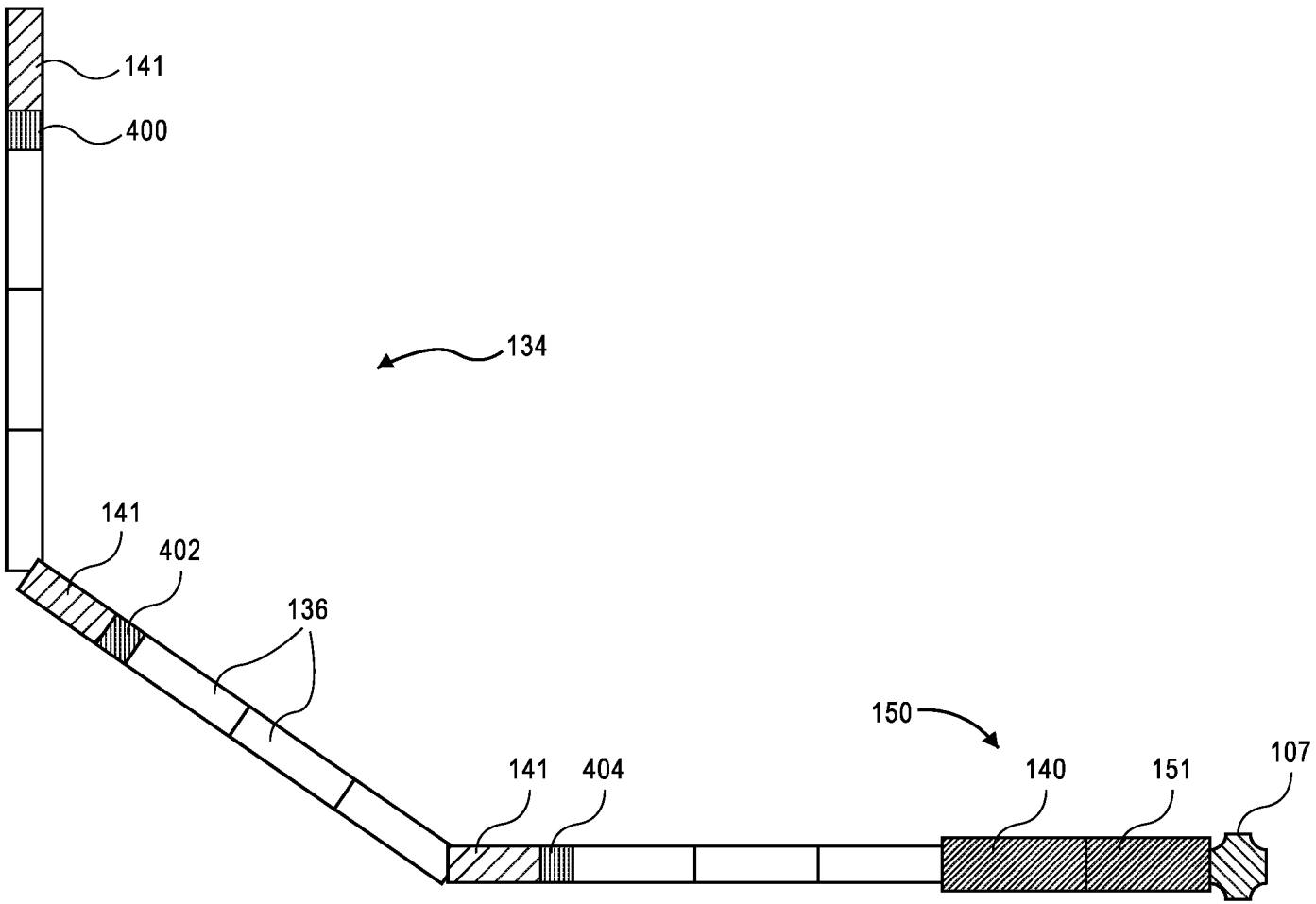
FIG. 4 illustrates a schematic view of a wired drill pipe assembly including a distributed system of several of the second downhole tools, in addition to the first downhole tool, according to an embodiment.

FIG. 4 illustrates a schematic view of the drill string assembly 134 including a plurality of second downhole tools 141 as well as the first downhole tool 140, according to an embodiment. The second downhole tools 141 may each be constructed generally similarly to the downhole tool 140 of FIG. 2. Further, the distribution of the second downhole tools 141 along the drill string assembly 134 may be at uniform, patterned, or otherwise varied intervals.

In some embodiments, the second downhole tools 141 may include respective sensors 400, 402, 404. The sensors 400, 402, 404 may be incorporated within the body 200 (FIG. 2) of the second downhole tools 141, e.g., as part of the electrical components 206 (FIG. 2) thereof. In other embodiments, the sensors 400, 402, 404 may be external (e.g., coupled) thereto. Further, the sensors 400, 402, 404 may be configured to measure direction and/or inclination parameters, torque, acceleration and/or velocity (e.g., rotational), shock, vibration, and/or the like, at the different locations along the drill string assembly 134. For example, the measurements from the sensors 400, 402, 404 may be employed to detect certain downhole conditions, such as stick-slip, drill pipe curvature information along the drill string assembly 134, etc. Accordingly, the orientation, curvature, trajectory, and other conditions relevant to the drilling operations may be measured at several nodes along the drill string assembly 134, rather than solely at or near to the BHA 150. This may provide a more complete picture of the operation of the drill string assembly 134.

The electrical components 206 of the second downhole tool 141 may also include a signal generator, in addition to or as part of the signal transmitter. The signal generator may be configured to communicate with the signal receiver to receive an upgoing or downgoing signal from another of the downhole tools 140, 141, the surface 102, the BHA 150, or from another component, and generate a signal configured to re-transmit the received signal via the transmission wire 152. In addition, the signal generator may be configured to add information to the upgoing or downgoing signals, e.g., to transmit one or more signals representing measurements taken by the plurality of sensors 400, 402, 404. The added signals may be transmitted sequentially to the received signals, or may be multiplexed therewith.

In some embodiments, the downhole tools 140, 141 may be configured as a toolbus for inter-tool communication. Thus, a downgoing signal from the surface may be received and relayed by the second downhole tools 141, to the first downhole tool 140, and ultimately to the BHA 150. The BHA 150 may then adjust a drilling parameter, such as a rate of rotation, tool face angle, etc. in response to (e.g., as directed by) such downgoing signals. Further, in some embodiments, commands from either or both of the first and second downhole tools 140, 141 may be sent via downlink through the wired drill pipes 136 to the BHA 150, for direct control thereof.

Accordingly, it will be appreciated that by decoupling the sensors from the MWD envelope (e.g., constraining the sensors to the connector sub between wired drill pipe and the MWD equipment) may allow for increased data collection in the drill string assembly 134, e.g., at a plurality of locations.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A wired drill string assembly, comprising:

a plurality of drill pipes extending from a surface into a wellbore, the plurality of drill pipes comprising a wired transmission line; and a downhole tool comprising:

a body having a first connector and a second connector, the first connector being connected to one of the plurality of drill pipes;

one or more electrical components comprising a sensor coupled to the body and a signal transmitter configured to transmit a signal representing a measurement taken by the sensor; and a first transmission line extending along the body and electrically connected to a transmission wire of the wired transmission line of the plurality of drill pipes and with the one or more electrical components, wherein the first transmission line is electrically connected to the transmission wire with a physical electrical contact.

2. The assembly of claim 1, wherein the sensor is configured to measure direction, inclination, or both.

3. The assembly of claim 2, wherein the one of the plurality of drill pipes is a distal-most drill pipe of the plurality of drill pipes, and wherein the second connector of the body is connected to a bottom-hole assembly.

4. The assembly of claim 3, wherein the one or more electrical components comprise a signal transmitter configured to transmit a first upgoing signal via the first transmission line, toward equipment positioned at the surface, wherein the first upgoing signal contains data representing a measurement taken by the sensor.

5. The assembly of claim 4, wherein downhole tool further comprises a second transmission line, the second transmission line extending along the body and being electrically connected to the bottom-hole assembly and the one or more electrical components.

6. The assembly of claim 1, wherein the one or more electrical components further comprise a signal receiver configured to receive a second upgoing signal via a second transmission line, and a signal generator configured to generate a first upgoing signal based on the second upgoing signal.

7. The assembly of claim 1, wherein the second connector of the body is connected to another one of the plurality of drill pipes, wherein the one or more electrical components comprise a sensor, and wherein the downhole tool is configured to transmit data representing a measurement taken by the sensor toward the surface, toward another downhole tool, to a bottom-hole assembly, or a combination thereof.

8. The assembly of claim 7, wherein the downhole tool is configured to receive a signal from the surface, from the bottom-hole assembly, or from another downhole tool located subjacent to the downhole tool, and to add the data representing the measurement to the signal.

9. The assembly of claim 7, further comprising a plurality of downhole tools including the downhole tool, wherein the plurality of downhole tools are positioned at one or more intervals along the drill string and communicating with the wired transmission line.

10. The assembly of claim 1, wherein the downhole tool further comprises a battery configured to provide power through the second connector to other components in the drill string assembly.

11. The assembly of claim 1, wherein the downhole tool further comprises a battery configured to draw power from other components in the drill string assembly through the second connector.

* * * * *